United States Patent [19]

Kern

[11] 4,369,666

[45] Jan. 25, 1983

[54] STARTER DRIVE ASSEMBLY

[75] Inventor: Calvin V. Kern, Maumee, Ohio

[73] Assignee: Eltra Corporation, Toledo, Ohio

[21] Appl. No.: 208,367

[22] Filed: Nov. 19, 1980

[51] Int. Cl.[3] ..... F02N 15/06; B21D 39/00

[52] U.S. Cl. ..... 74/7 R; 29/511; 29/513; 29/516

[58] Field of Search ..... 74/6, 7 R; 29/511, 513, 29/516

[56] References Cited

U.S. PATENT DOCUMENTS

| | | | |
|---|---|---|---|
| 2,244,265 | 6/1941 | Sekella | 74/7 R |
| 2,319,688 | 5/1943 | Jones | 74/7 R |
| 2,915,903 | 12/1959 | Digby et al. | 74/7 R |
| 3,818,768 | 6/1974 | Hardy | 74/7 R X |
| 4,255,982 | 3/1981 | Kern | 74/7 R |

*Primary Examiner*—Allan D. Herrmann

*Attorney, Agent, or Firm*—James P. DeClercq

[57] ABSTRACT

A pinion gear assembly for a starter motor which may be assembled utilizing a simple and convenient assembly process. The pinion gear assembly includes a pinion gear, a cup, a rubber washer, and a spline follower. The closed end of the cup has an opening which passes the body and teeth of the pinion gear, but does not pass intertooth fillets at one end of the pinion gear, thus keeping the pinion gear retained in the cup. The rubber washer is retained between the pinion gear and the spline follower, and acts to absorb shock and allow some movement to align teeth of the pinion gear with teeth of a mating ring gear or flywheel. In assembly, the spline follower is held in alignment with the pinion gear, and the material of the cup is pressed radially inward over the rear surface of the spline follower, forming retaining step portions for retaining the spline follower in the proper alignment. Notches may be provided adjacent the portions which are pressed radially inward to allow this deformation without shearing or tearing the material of the cup, so as not to disturb a corrosion protecting coating on the cup. The cup may be further provided with indentations forming protrusions which cooperate with grooves in the outer periphery of the spline follower, to restrain the spline follower from rotation with respect to the cup and pinion gear.

10 Claims, 9 Drawing Figures

STARTER DRIVE ASSEMBLY

BACKGROUND OF THE INVENTION

This invention relates generally to a starting apparatus for cranking an internal combustion engine, and more specifically relates to a pinion gear assembly for momentarily engaging an engine flywheel and transferring power from a starter motor to the internal combustion engine.

The concept and various embodiments of automatically engaging and disengaging starting mechanisms for internal combustion engines are well-known. Such pinion gears may be engaged mechanically, or by their own inertia, and the assembly may be allowed to slip, or twist or to compress, to properly align the teeth of the pinion gear with the teeth of the flywheel or ring gear. The disclosed embodiment of the invention is a pinion gear assembly of the inertia type, which compresses for alignment, although, as will become apparent, the novel construction of this pinion gear assembly allows its use with the mechanically-engaged and the tension of controlled-slip type of pinion gear assemblies. A conventional mechanism comprises a plurality of teeth in the flywheel in an internal combustion engine or in a ring gear secured to the crank shaft of such an engine, adjacent a pinion gear coupled to the output shaft of a starting motor. In the mechanically-engaged pinion gear, when the starter motor is actuated and begins to rotate, a separate solenoid, operating a lever arm, forces the pinion gear towards the flywheel or ring gear, and into engagement with its teeth. When the starter motor is deactivated, a spring forces the pinion gear assembly out of engagement with the teeth of the ring or flywheel gear, and back along motor shaft. With the inertia type of pinion gear assembly, when the starting motor is actuated and begins to rotate, the inertia of the pinion resists rotation, and a helical spline on the motor shaft causes the pinion to translate actually along the motor shaft and into engagement with the gear teeth associated with the engine crank shaft. The engine is thus cranked until the engine speed passes through the speed at which the starting motor drives it, momentarily releasing the load from the teeth of the pinion gear and allowing a spring biasing force to disengage the pinion gear from the engine gear.

As will be apparent, when the pinion gear approaches the flywheel or ring gear, the teeth of the two gears are randomly oriented, and the pinion gear may strike against the sides of the teeth of the pinion or ring gear rather than engage these teeth. The starter motor will continue to rotate, and some means must be provided to absorb the shock of impact between the gears, allow relative movement of the gears until they engage, or allow axial movement of part of the pinion gear assembly without actual movement of the pinion gear under the influence of a rotating, helical splined shaft. Typically, a resilient or friction material is interposed between a spline follower and the pinion gear, to allow twisting or slipping rotation of the spline follower with respect to the pinion gear, or to allow axial movement between the spline follower and pinion gear, or both. The disclosed embodiment of the invention uses a resilient member, allowing axial movement only, although the concepts disclosed are equally applicable to a pinion gear assembly utilizing twisting or controlled slip.

Numerous modifications and improvements have been made to this basic mechanism. However, numerous deficiencies and problems still remain. Among such difficulties is the difficulty of maintaining proper alignment between a pinion gear and the spline follower portion of a pinion gear assembly, particularly in pinion gear assemblies used on smaller engines. As will be apparent, the pinion gear and spline follower portions of a pinion gear assembly move on a common shaft, and misalignment between these two portions causes rapid wear of the pinion gear assembly, or of the shaft, and often results in failure to crank, or failure to disengage the pinion gear assembly binding on the starting motor shaft. This may also result in starting motor failure from overspeeding.

Attempts have been made to provide a structure for a pinion gear assembly which is not subject to misalignment upon assembly. Such structures have generally required extensive and precise machining operations, or a welded or brazed assembly.

A particular difficulty of modifying this mechanism is the dimensional constraint placed upon its size by associated components. Commonly, the starter mechanism will be positioned within a housing or adjacent engine components which closely limit its size. Therefore, unless redesign of the entire starting motor assembly and perhaps even engine components is permitted, refinements to the starter mechanism must be made within dimensional limits established by these associated components. The development of a new component or production technique thus leaves to the additional consideration of adapting such an improvement to the presently utilized components.

A conventional starter motor pinion gear assembly includes an outer metal cup or shell which secures, in operating relationship, a spline follower, a resilient washer member which may function as a friction clutch, and the pinion gear itself. The cup is secured to the pinion gear, and these components are moved as previously explained, with the spline follower following splines in the starter motor shaft. Prior art pinion gears are commonly hobbed or drop-forged and may easily be attached to the drawn cup by conventional means such as welding or brazing, as is taught by U.S. Pat. No. 3,071,013. The recently developed capability of forming the pinion gears of powdered metal and then sintering them produces an improved pinion gear, but does not solve the difficulties with regard to the assembling of pinion gear assemblies. Conventional welding and brazing techniques, while ultimately capable of performing such a bonding operation, reliably do so only under carefully controlled conditions, and the rejection rate of completed assemblies and the difficulties inherent in such a bonding process offset the advantages of a powdered metal pinion gear.

Also, while welding and brazing techniques may be used at assembly to provide a pinion gear assembly with adequate alignment between its members, this advantage is offset by the high rate of rejection of completed welded or brazed assemblies. A starter drive pinion gear assembly which uses a powdered metal pinion gear and which can be assembled without welding or brazing is shown in applicant's prior application, Ser. No. 965,158, filed Nov. 30, 1978, now U.S. Pat. No. 4,255,982 date Mar. 17, 1981, and entitled "Starter Assembly Utilizing a Castellated Cup". This pinion gear assembly is of the twist or controlled-slip type, and includes a pinion gear having an annular base, the cup having an open end in a castellated configuration, the protrusions of the castellation being folded down between the teeth of the pinion gear, against the annular base. In production, this technique may not always provide acceptable alignment, due to nonuniformity of the metal of the cup, so that when applying uniform force to each of the castellation portions, the castellated portions may move unequally, some not contacting the annular base, and some forcing the pinion gear into the resilient washer, misaligning the pinion gear. Also, this type of construction is limited to those applications where there is physically room for a cup member with large enough castellations to be practically bent into position with a reasonable degree of repeatability.

It has also been proposed to place such a powdered metal pinion gear through a correspondingly-serrated opening in the bottom of a cup member, placing a resilient washer and spline follower into the cup, and then folding previously-slotted tabs formed in the edge of the open end of the cup against the back of the spline follower, retaining the spline follower in the cup and preloading the rubber washer. While usable with smaller engines and more constrained spaces, this approach is subject to severe misalignment, the tabs, typically four in number, not folding inward and downward evenly under identical pressure due to nonuniformity of material about the periphery of the cup member. Such a cup member may be made by stamping or drawing.

Pinion gear assemblies which overcome such deficiencies have been constructed but have been unable to utilize the advantage of powdered metal pinion gears, and have required extensive machining. One such device known to applicant is machined on all surfaces, and has a pinion gear member integral with the cup member. There is a cup member, a short axial protrusion from one end of the cup member, and a pinion gear on this protrusion. Such a shape must necessarily be a machined cast shape, with the outside of the cup machined by turning, the short axial protrusion being machined by turning, and the pinion gear portion at the end of the axial protrusion being then machined by hobbing or broaching. This inside of the cup portion must be machined, as must the bore through the axial protrusion and pinion gear. Further, a snap ring groove is machined near the opened end of the cup member for receiving a snap ring which holds a resilient washer and cam follower in the cup member. The cup member is also provided with four indentations around its perimeter, aligned with matching recesses in the periphery of the spline follower, thus locking the spline follower to the cup member for use as a inertia drive starter coupling of the compression type.

As will be apparent, such a construction is not only unnecessarily costly and subject to numerous assembly operations, leading to numerous individual sources of error and a high rate of rejection of such assemblies.

SUMMARY OF THE INVENTION

The instant invention is directed to a starting motor pinion gear assembly which comprises a drawn cup having a gear-shaped opening on one end which accepts and retains sintered metal pinion gears having various outer diameters and an annular bottom land. The cup also contains a resilient washer member and a spline follower member.

At assembly, the pinion gear is placed through the bottom opening, the resilient washer is placed in the cup in contact with the pinion gear, and the spline follower is placed in the cup in contact with the resilient washer. Then, the spline follower member is pressed towards the pinion gear, compressing the resilient washer, with the spline follower member and the pinion gear being held in a parallel relationship, the axis of the spline follower and the pinion gear being thus held continuous by the cup. Then, at a plurality of circumferentially spaced points, the material of the cup is pressed radially inward adjacent the opened end of the cup, forming edges against which the spline follower member is supported. The spline follower may be used as a shearing die, the material being pushed radially inward being shearted at the edge of the spline follower member, or the cup may be preliminarily notched so that ledges may be formed without shearing of metal, so that corrosion-resistant coatings may be applied before assembly, and not broken by assembly operations.

Thus, it is the object of the instant invention to provide a pinion gear starter assembly utilizing a powdered metal pinion gear. It is a feature of the invention that the powdered metal pinion gear and the spline follower member are placed in accurate alignment during assembly. It is a feature of the invention that multiple machining operations are not necessary to provide this advantage.

It is a further object of the invention to provide a pinion gear starter assembly utilizing a powdered metal pinion gear which is dimensionally identical and interchangable with conventional pinion gear starter assemblies. It is a feature of the invention that a drawn cup member may be used with a variety of pinion gear sizes. It is an advantage of the invention that embodiments of the invention may be made in various sizes to be dimensionally identical to an interchangable with conventional pinion gear starter assembly.

It is a still further object of the invention to provide a pinion gear starter assembly utilizing a powdered metal pinion gear assembled to a drawn cup housing which does not utilize welding or brazing attachment means, and which does not require machining to provide accurate alignment between a pinion gear and a spline follower member. It is a feature of the invention that alignment between a pinion gear and a spline follower member is provided by deflecting the cup member radially inward at a plurality of circumferentially spaced points adjacent its open end to form edges or stops on the interior diameter of the cup to retain the spline follower in a preset alignment with the pinion gear. It is a feature of the invention that the spline follower itself acts, at least in part, as a die, controlling, the axial location of the radial deflection of the periphery of the cup member, to form edges or stops on the interior diameter of the cup member at locations determined by the predetermined position of the spline follower member with respect to the pinion gear.

DESCRIPTION OF THE PREFERRED EMBODIMENTS

Figure 1:
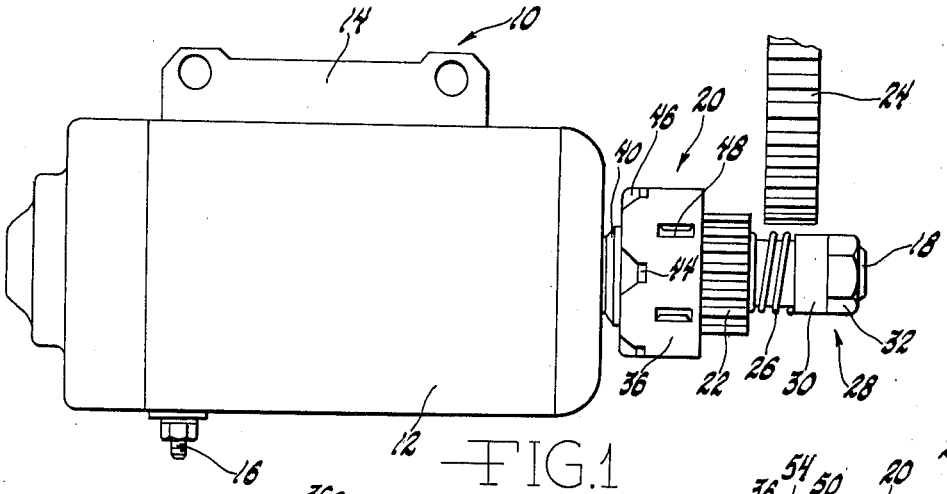
FIG. 1 is a fragmentary side elevational view of the starter motor and pinion gear assembly according to the invention.
Figure 2:
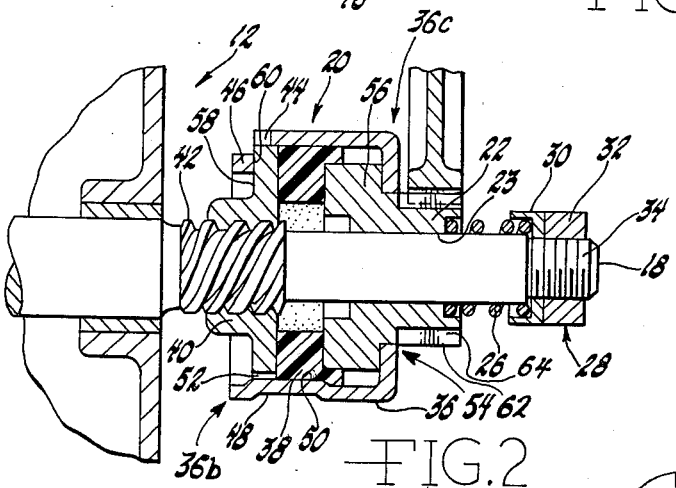
FIG. 2 is an enlarged sectional view of a pinion gear starter assembly shown in FIG. 1.

Referring to FIGS. 1 and 2, a starter drive assembly is shown generally as assembly 10, including a starting motor 12 with mounting provisions 14 and power supply provision 16. Starting motor 12 has a shaft 18 protruding from one end, upon which is mounted a pinion gear assembly shown generally as 20. In FIGS. 1 and 2, pinion gear assembly 20 is shown in disengaged position, with pinion gear 22 held out of engagement with the gear teeth on motor flywheel or ring gear 24 by a resilient means shown as helical spring 26. Helical spring 26 is retained by barrier means 28 including spring cup 30 and nut 32, cooperating with threads 34 of shaft 18.

Pinion gear assembly 20 includes pinion gear 22, having a bore shown as hole 23 for slidably receiving shaft 18, a resilient member shown as rubber washer 38 and a spline follower 40 cooperating with splines shown in FIG. 2 as helical splines 42. Pinion gear 22 includes a plurality of gear teeth 62 projecting from bottom land 64. Spline follower 40 has splines 43 shown here as helical splines, to match the splines 42 of shaft 18. Cup 36 is shown as having a closed end 36*c* and an open end 36*b*, and as including notches 44, displaced portions 46 and depressions 48 forming protrusions 50, cooperating with grooves 52 of spline follower 40. For purposes of the instant application, end 36*c* is described as a closed end, to distinguish it from end 36*b*, called an open end, and from the starter drive shown in U.S. Pat. No. 4,255,982 dated Mar. 17, 1981, where a pinion gear is retained by folding an open end of a cup having a castellated shape with tang portions which are folded inwardly between teeth of the pinion gear.

Figure 3:
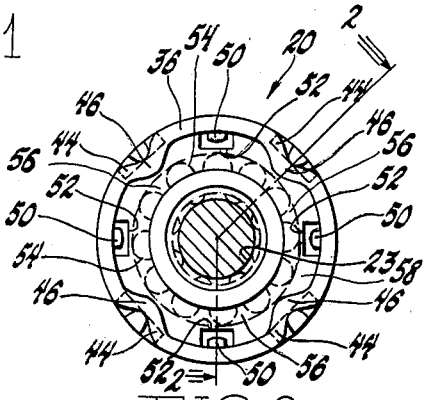
FIG. 3 is a rear elevational view of the pinion gear starter drive according to the preferred embodiment of the invention.

FIG. 3 is a rear elevational view of the pinion gear assembly 20 shown in FIG. 2, FIG. 2 being a sectional view taken along line 2—2 in FIG. 3. As will be explained more fully below, FIGS. 1, 2, and 3 illustrate the preferred embodiment of a pinion gear assembly according to the invention, the addition of notches 44 allowing cup 36 to be made of a material which is not inherently corosion-resistant, and coated with a corrosion-resistant material, since the provision of notches 44 allows portions 46 to be displaced without shearing or tearing of the material and its corrosion-resistant coating. As will be apparent, if the material of cup 36 were to be sheared or torn, there is a possibility that corrosion-proofing material would not cover all surfaces if applied after assembly.

As will be apparent, when shaft 18 of starting motor 12 begins to rotate due to the presence of electric power at power supply provisions 16, the inertia of pinion gear assembly 20 will tend to keep it from rotating, and lag behind the rotational speed of shaft 18. Thus, spline follower 40, cooperating with helical splines 42 of shaft 18, will cause pinion gear assembly 20, and pinion gear 22 to move towards flywheel or ring gear 24 and engage the teeth of flywheel or ring gear 24 to crank an associated engine. In the embodiment shown, spline follower 40 is prevented from rotation with respect to cup 36 by protrusions 50 cooperating with grooves 52, and pinion gear 22 is forced to rotate with cup 36 because the closed end 36*c* of cup 36 is formed with an opening 54 in the shape of the endwise profile of pinion gear 22. Pinion gear 22 is retained in cup 36 by means of intertooth webs or fillets 56 projecting from land 64, which obviously, will not pass through opening 54. Spline follower 40 is maintained in cup 36, in alignment with pinion gear 22, as will be explained further below.

Pinion gear 22 and spline follower 40 are placed in initial alignment, and displaced portions 46 are forced radially inward against rear surface 58 of spline follower 40, the resilience of resilient means here shown as rubber washer 38 maintaining rear surface 58 of spline follower 40 against the retaining step portions 60 formed by displaced portions 46. The forming of displaced portions 46 does not disturb the alignment of spline follower 40 and pinion gear 26, spline follower 40 acting as a die for forming the retaining step portions which entrap it in the cup in alignment with the pinion gear.

In the illustrated embodiment, the resilient member shown as rubber washer 38 serves to allow spline follower 40, to move towards pinion gear 22 should the teeth of pinion gear 22 not be in alignment with the teeth of ring gear of flywheel 24 at the instant of engagement. This allows spline follower 40 to continue to move towards the engaged position, to the right as shown in FIG. 1, and continue to rotate, thus bringing the teeth of pinion gear 22 into alignment so they can engage with the teeth of flywheel or ring gear 24.

As will be apparent, depressions 48 protrusions 50 and grooves 52 may be eliminated from the illustrated embodiment of the invention, and the resilient member shown as rubber washer 38 may be used for rotational coupling between a spline follower and a pinion gear, merely by applying a greater initial compressive load to rubber washer 38.

Figure 4:
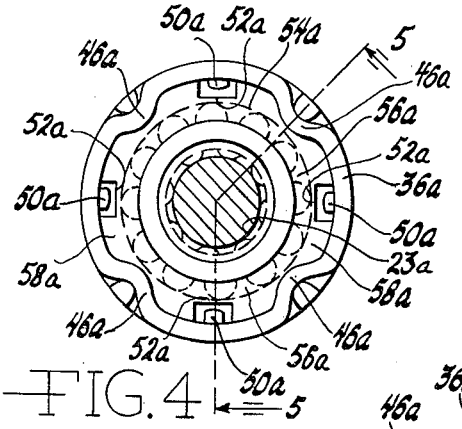
FIG. 4 is a rear elevational view of an alternate embodiment of the invention.
Figure 5:
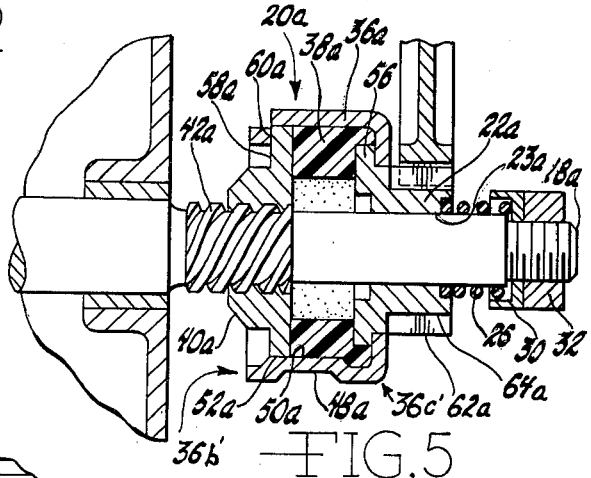
FIG. 5 is a side elevational view, partially in section of the second alternate embodiment of the invention, taken along line 5—5 in FIG. 4.
Figure 6:
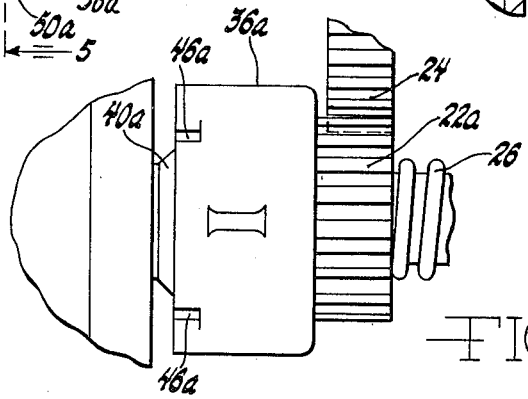
FIG. 6 is a side elevational view of the alternate embodiment of the invention.

FIGS. 4, 5 and 6 show a pinion gear assembly identical to that shown as pinion gear assembly 20, except that notches such as notches 44 are not provided, the material of the cup member being sheared or torn to form displaced portions to maintain the spline follower in alignment with the pinion gear, and therefore will be shown with the same identifying reference numbers as the embodiment shown in FIGS. 1, 2 and 3, with the suffix "a" or marked with a prime if the reference numeral is already shown with an alphabetic suffix. As will be apparent, the embodiment illustrated in FIGS. 4, 5 and 6 is functionally identical to that shown in FIGS. 1, 2 and 3.

Figure 7:
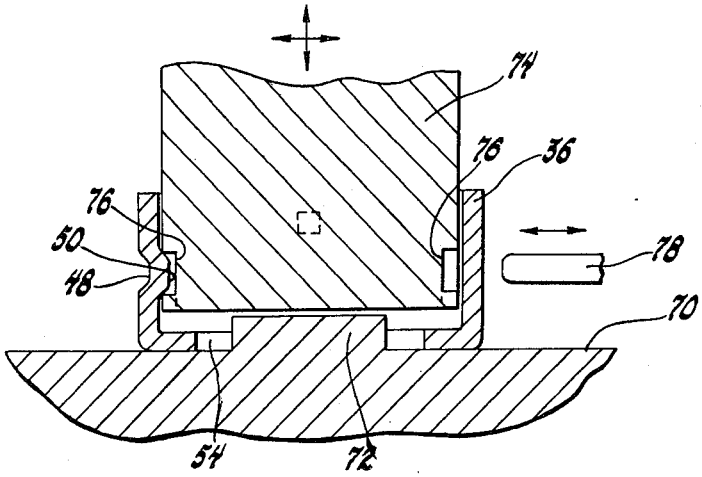
FIG. 7 is a illustration of a first step in the assembly of a pinion gear starter assembly according to the preferred embodiment of the invention.
Figure 8:
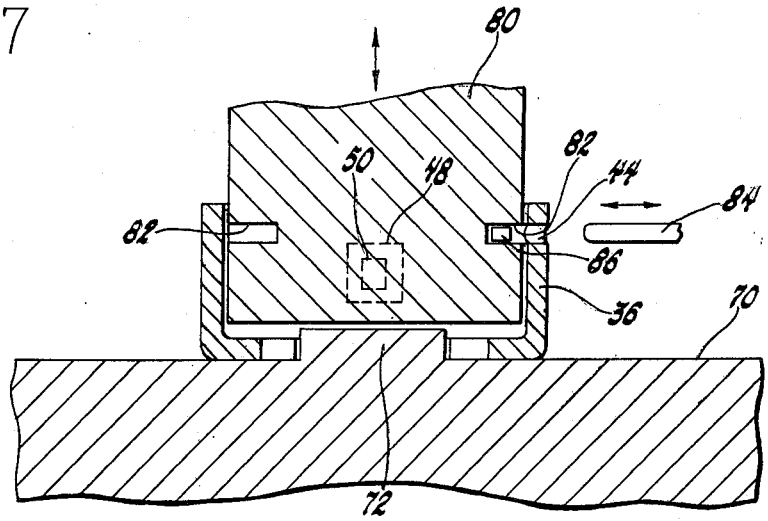
FIG. 8 is a schematic illustration of a second step in the assembly of a pinion gear starter assembly according to the preferred embodiment of the invention.
Figure 9:
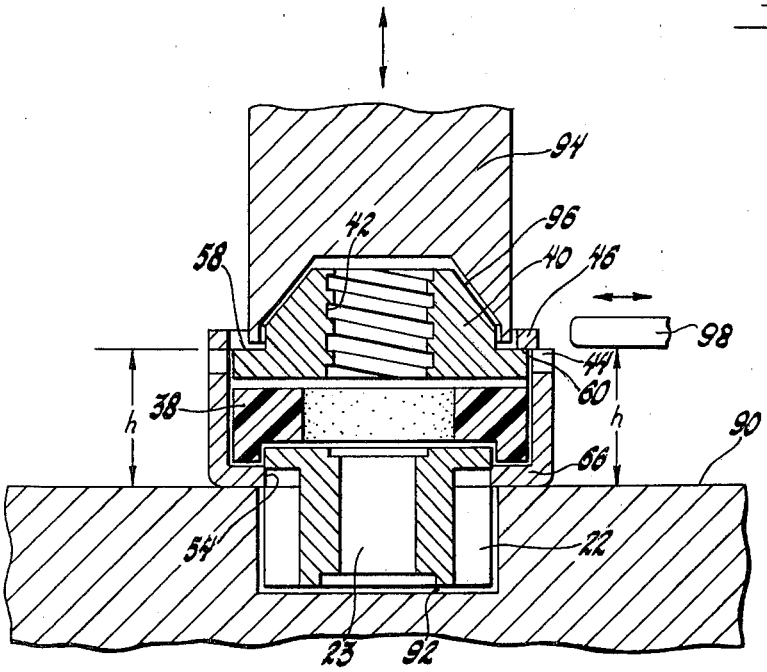
FIG. 9 is a schematic illustration of a third step in assembling a pinion gear starter assembly according to the preferred embodiment of the invention.

FIGS. 7, 8 and 9, illustrate schematically three steps in producing a pinion gear assembly according to the invention, FIG. 8 illustrating an optional step which may be omitted for the embodiment shown in FIGS. 4, 5 and 6.

It should be specifically noted that the steps illustrated in FIGS. 7, 8 and 9, are schematic in nature, and are not intended to illustrate a particular machine, since the illustrated embodiments of the invention can conveniently be manufactured on conventional machines on either horizontal or vertical alignment, with a variety of standard or custom tooling. For clarity of illustration, FIGS. 7, 8 and 9, reflect a vertical-axis machine fitted with appropriate tooling.

As shown in FIG. 6, a cup 36 may be placed on a support surface 70 having a locating projection 72 which engages opening 54 or 54*a*. As illustrated, a mandrel 74 including L-shaped recesses 76 is moved down into cup 36, and a tool 78 is moved radially inward to form depressions 48 or 48*a* and protrusions 50 or 50*a*. After the tool is withdrawn, the mandrel 74 is rotated slightly so that it can be withdrawn past protrusions 50. As explained above, this step may be omitted, if it is desired to use pinion gear assembly 20 or 20*a* and rely on friction to transmit the torque from the spline follower 40 to the rubber washer 38 and then to the drive cup 36 and pinion 22.

In FIG. 8, cup 36 is shown in place on support surface 70, and a second mandrel 80 is moved down into cup 36. Mandrel 80 includes recesses 82. Then, notching tool 84 is moved radially inward, forming a notch 44, removed material 86 being forced into recesses 80. Then, second mandrel 82 is withdrawn, and removed material 86 may be cleared from recesses 82 in conventional fashion.

Steps shown schematically in FIG. 8 may be conveniently omitted if, by reason of the materials used, or for another reason, it is not considered necessary or desirable to prevent the material of cup 36 from shearing or being torn during the assembly operation. As will also be apparent, the production steps shown in FIGS. 7, 8 and 9, may be performed at all locations simultaneously. For instance, in FIG. 6, four depressions 48 or 48*a* could be formed simultaneously by the use of four tools 78. Correspondingly, in FIG. 8, the use of four tools 84 simultaneously would result in the forming of four notches 44 simultaneously.

FIG. 9 shows schematically the assembly of a pinion gear assembly 20. It will be obvious that the same procedure applies to the assembly of a pinion gear assembly 20*a*. A cup 36 is placed on a reference surface 90, and a pinion gear 22 is placed through opening 54 into a recess 92 in reference surface 90. Then, a resilient member or rubber washer 38 is placed into cup 36, and followed by spline follower 40, which may have grooves such as grooves 52, as shown in FIG. 3, to be aligned with protrusions such as protrusions 50, as shown in FIG. 3. Then, an aligning mandrel 94, with a surface conforming to surface 96 of spline follower 40 and rear surface 58 of spline follower 40, may move downwardly against spline follower 40, pressing against spline follower 40 to compress resilient member 38, and position rear surface 58 at a predetermined height h above reference surface 90, thus positioning the axis of spline follower 40 and the axis of pinion gear 22 in coincident alignment. Then, a lancing tool 98 positioned at predetermined distance h above reference surface 90 is moved radially inward against cup 36, forcing displaced portion 46 radially inward over rear surface 58 of spline follower 42 to form retaining step portion 60, retaining spline follower 40 and pinion gear 22 in the predetermined alignment. As shown, notches 44 allow displaced portions 46 to be displaced radially inward without the tearing or shearing of the material of cup 36. As will be apparent, this operation may be either performed simultaneously at several circumferentially spaced locations, four such locations being used in the preferred embodiment of the invention, or each displaced portion 46 may be displaced individually in sequence. In either case, pinion gear assembly 22 may be precisely aligned and maintained in that precise alignment without any complex machining operations, without the addition of any parts to maintain the assembly as a unit, and without the use of any production processes which have a tendency to produce a pinion gear assembly of nonrepeatable quality.

As stated above, FIGS. 7, 8 and 9 are schematic views only, illustrative of the general procedure for making the invention. The actual production tooling involved, which is not part of applicant's invention uses three separate fouractuator dies, for performing the three operations shown on FIGS. 7, 8 and 9 simultaneously at four spaced locations around cup member 36.

The operation shown in FIG. 7 is actually performed with cup member 36 inverted from the position shown, with the mandrel being the fixed part of the die, and cup 36 being placed over the mandrel and held down while four punches 78 act simultaneously.

The same is true of the operation schematically illustrated by FIG. 8. Cup 36 is inverted over a mandrel having a hollow center connected to recesses 82, so that material 86 removed by the simultaneous operation of four notching tools such as notching tool 84 will fall clear.

A third die for implementing the step shown schematically in FIG. 9 also has four separate actuators operating four tools shown as lancing tool 98. A mandrel similar to mandrel 94 but having a projection for engaging spline follower 40 and hole 23 of pinion gear 22 for holding spline follower 40 and pinion gear 22 in alignment regardless of the precise alignment of recess 92 and mandrel 94 is preferably used. The production of dies and tooling to implement the manufacturing steps shown schematically here is well within the skill of a die maker, and the features of production dies and tooling designed by a tool and die maker form no part of the instant invention.

As will be apparent, there are numerous other modifications and variations of the disclosed embodiments of the invention that may be made by one skilled in the art, without departing from the spirit and scope of the invention.

I claim:

1. A starter motor pinion gear assembly comprising:

a cylindrical cup having a first closed end and a second open end;

said first end defining an opening therethrough, said opening having a periphery in the shape of an endwise profile of a pinion gear and being adapted to receive a pinion gear therethrough;

a spline follower positioned within said cup and defining a spline opening therethrough;

a pinion gear positioned within said cup and having teeth projecting radially outward from a bottom land and having intertooth fillets projecting radially outward from said bottom land at one end thereof;

said teeth being disposed through said opening, and said intertooth fillets being disposed within said cup to retain said gear in said cup;

a resilient means interposed between said gear and said spline follower;

said cup having a plurality of circumferentially-spaced portions adjacent said second open end being displaced radially inward adjacent a surface of said spline follower distant to said resilient means;

said circumferentially-spaced displaced portions forming retaining step portions for entrapping said spline follower in alignment with said pinion gear;

said spline follower including a plurality of grooves defined in a periphery of said spline follower, said grooves being aligned with an axis of said cylindrical cup;

said cup defining a plurality of depressions in an outer periphery thereof, each said depression defining protrusions from an inner periphery of said cup;

said protrusions and said grooves being adapted to cooperate to restrain said spline follower from rotation with said cup;

said spline opening of said spline follower being a helically spline opening;

said cylindrical cup defining a plurality of notches, each said notch being disposed adjacent one said displaced portion for allowing said portion to be displaced without shearing the material of said cylindrical cup.

2. An engine cranking apparatus comprising:

a starting motor having a shaft extending therefrom;

said starting motor shaft including a helical spline along a portion of its length and a barrier disposed about said shaft;

an engine drive gear;

a pinion gear assembly positioned to slide between engaged and disengaged positions on said starting motor shaft;

said pinion gear assembly including a cylindrical cup, a pinion gear, a resilient means, and a spline follower;

said pinion gear having teeth, a first end, and a plurality of innertooth webs at said first end;

said spline follower defining a helically spline opening therethrough;

said cylindrical cup having a first closed end and a second open end, said first end defining an opening therethrough, said opening having a periphery in the shape of an endwise profile of a pinion gear;

said pinion gear being disposed through said opening, said intertooth webs at said first end retaining said gear in said cup;

said resilient means being disposed in said cup adjacent said first end of said pinion gear;

said spline follower being disposed in said cup adjacent said resilient means;

a plurality of circumferentially-spaced portions adjacent said second end of said cylindrical cup being displaced radially inward;

said circumferentially-spaced displaced portions being disposed adjacent the surface of said spline follower and defining a plurality of retaining step portions for entrapping said spline follower, said resilient means and said pinion gear in said cup;

said cylindrical cup defining a plurality of notches, each said notch being disposed adjacent one said displaced portion for allowing said portion to be displaced without shearing the material of said cylindrical cup;

wherein said helically spline opening of said spline follower engages said engine drive gear when said pinion gear assembly is in said engaged position.

3. An engine cranking apparatus according to claim 2, further including a compression spring positioned about said shaft and disposed between said pinion gear assembly and said barrier.

4. An engine cranking apparatus according to claim 2, wherein:

said spline follower has an outer periphery defining a plurality of grooves, said grooves being aligned with an axis of said cylindrical cup;

said cup defining a plurality of depressions in an outer periphery thereof, said depressions defining protrusions from an inner periphery of said cup;

said protrusions and said groove cooperate to restrain said spline follower from rotation within said cup.

5. An engine cranking apparatus, comprising:

a starting motor having a shaft extending therefrom;

said starting motor shaft including a helical spline along a portion of its length and a removable barrier disposed about said shaft adjacent to its end;

an engine drive gear;

a pinion gear assembly positioned to slide between engaged and disengaged positions on said shaft;

a compression spring disposed on said shaft between said barrier and said pinion gear assembly to urge said pinion gear assembly toward said disengaged position;

said pinion gear assembly including a pinion gear having a plurality of teeth, an end, and a plurality of intertooth webs at said end and defining an opening therethrough, a spline follower defining a helically splined opening therethrough aligned with said opening of said pinion gear and engaging said starter motor shaft spline, resilient means interposed between said pinion gear and said spline follower and a cylindrical cup for receiving and retaining said pinion gear; said resilient means and said spline follower;

said cup having a first closed end and a second open end;

said closed end defining an opening for receiving said teeth of said pinion gear therethrough, said intertooth webs of said pinion gear being disposed adjacent an inner surface of said cup to retain said gear;

said cup including a plurality of circumferentially spaced portions deformed radially inward adjacent said open end, said deformed portions forming retaining portions for entrapping said spline follower in alignment with said pinion gear;

said cup further defining a plurality of notches therethrough, each said notch being disposed adjacent one said deformed portion for allowing said cup to be deformed without shearing the material of said cup;

said spline follower defining a plurality of grooves aligned with an axis of said cup on the periphery of said spline follower;

said cup defining a plurality of depressions in an outer surface of said cup, each said depression defining a protrusion from said inner surface of said cup, said protrusions cooperating with said grooves for restraining said spline follower from rotation in said cup.

6. A method of making a starting motor pinion gear assembly including the steps of:

providing a cup member having a first closed end defining an opening in the shape of an endwise profile of a pinion gear and a second open end;

placing the teeth of a pinion gear having teeth and a plurality of intertooth webs at one end thereof through said opening with the intertooth webs against the inner surface of said cup;

placing a resilient member in said cup;

placing a spline follower in said cup;

compressing said resilient member by pressing said spline follower towards said pinion gear and aligning said pinion gear and said spline follower;

deforming a plurality of circumferentially-spaced portions adjacent the open end of said cup radially inward over a surface of said spline follower distal to said resilient member to form retaining steps for retaining said spline follower in said cup in alignment with said pinion gear.

7. A method of making a starting motor pinion gear assembly according to claim 6, including the further step of:

forming a plurality of indentations about the periphery of said cup to form a plurality of protrusions from an inner surface of said cup; and wherein the step of placing said spline follower in said cup comprises the step of placing a spline follower having a plurality of grooves in a periphery thereof corresponding to said protrusions in said cup with said grooves aligned with said protrusions.

8. A method of making a starting motor pinion gear assembly according to claim 6, including the further step of:

forming a plurality of circumferentially-spaced notches through a wall of said cup before the step of deforming said plurality of circumferentially-spaced portions adjacent to the open end of the cup over said surface of said spline follower, said portions being deformed without shearing said wall of said cup.

9. A method of making a starting motor pinion gear assembly including the steps of:

providing a cup member having a first closed end defining an opening in the shape of an endwise profile of a pinion gear and a second open end;

placing the teeth of a pinion gear having teeth and a plurality of intertooth webs at one end thereof through an opening with the intertooth webs against the inner surface of said cup;

placing a resilient member in said cup;

placing a spline follower in said cup;

compressing said resilient member by pressing said spline follower towards said pinion gear and aligning said pinion gear and said spline follower;

deforming a plurality of circumferentially-spaced portions adjacent the open end of said cup radially inward over a surface of said spline follower distal to said resilient member to form retaining steps for retaining said spline follower in said cup in alignment with said pinion gear;

forming a plurality of circumferentially-spaced notches through a wall of said cup before the step of deforming said plurality of circumferentially-spaced portions adjacent to the open end of the cup over said surface of said spline follower, said portions being deformed without shearing said wall of said cup.

10. A method of making a starter motor pinion gear according to claim 7, including the further step of:

forming a plurality of indentations about the periphery of said cup to form a plurality of protrusions from an inner surface of said cup;

and wherein the step of placing said spline follower in said cup comprises the step of placing a spline follower having a plurality of grooves in a periphery thereof corresponding to said protrusions in said cup with said grooves aligned with said protrusions.

* * * * *